US012324467B2

(12) United States Patent
Potnis

(10) Patent No.: US 12,324,467 B2
(45) Date of Patent: Jun. 10, 2025

(54) APPARATUS, SYSTEMS, AND METHODS FOR PREVENTING FLUID FROM ENTERING AN INTERFACE

(71) Applicant: O&M Halyard, Inc., Mechanicsville, VA (US)

(72) Inventor: Prasad S. Potnis, Johns Creek, GA (US)

(73) Assignee: O&M Halyard, Inc., Mechanicsville, VA (US)

( * ) Notice: Subject to any disclaimer, the term of this patent is extended or adjusted under 35 U.S.C. 154(b) by 576 days.

(21) Appl. No.: 16/871,383

(22) Filed: May 11, 2020

(65) Prior Publication Data

US 2020/0359719 A1 Nov. 19, 2020

Related U.S. Application Data

(60) Provisional application No. 62/848,635, filed on May 16, 2019.

(51) Int. Cl.
*A41D 19/00* (2006.01)

(52) U.S. Cl.
CPC ..... *A41D 19/0037* (2013.01)

(58) Field of Classification Search
CPC ..... A41D 19/0037; A41D 13/0005; A41D 19/0048; A41D 19/0089; A41D 19/0041; A41F 1/06
See application file for complete search history.

(56) References Cited

U.S. PATENT DOCUMENTS

| | | | | |
|---|---|---|---|---|
| 3,747,126 | A | 7/1973 | Hoagland | |
| 3,793,644 | A * | 2/1974 | Kellner | A41D 15/002 2/48 |
| 5,555,561 | A | 9/1996 | Plachta et al. | |
| 5,628,067 | A | 5/1997 | Meyer et al. | |
| 5,734,992 | A | 4/1998 | Ross | |
| 5,800,372 | A * | 9/1998 | Bell | A61L 15/225 128/DIG. 8 |

(Continued)

FOREIGN PATENT DOCUMENTS

| | | |
|---|---|---|
| DE | 9214949 U1 | 3/1994 |
| WO | WO 97/40767 A2 | 11/1997 |

OTHER PUBLICATIONS

International Search Report and Written Opinion for PCT/US2020/032308, dated Aug. 14, 2020, 13 pages.

*Primary Examiner* — Sally Haden

(57) ABSTRACT

Apparatus, systems, and methods for preventing fluid from entering an interface are provided. For example, a strap is provided for preventing fluid from entering an interface. The strap comprises a first layer comprising an elastic material and a second layer comprising a superabsorbent material. The strap extends about or around a first material at a position at or near an interface between the first material and a second material. The interface may be an interface between a surgical gown and a surgical glove worn by a healthcare provider, and the strap may extend about the gown at a position at or near the glove. In some embodiments, the strap comprises an absorptive facing and an elastic laminate. The absorptive facing comprises a carded web containing superabsorbent fibers. Further, the absorptive facing and elastic laminate form a stretchable material having absorptive properties.

17 Claims, 4 Drawing Sheets

(56) References Cited

U.S. PATENT DOCUMENTS

| | | | | |
|---|---|---|---|---|
| 6,059,764 | A * | 5/2000 | Osborn, III | A61F 13/47218 604/389 |
| 6,092,237 | A | 7/2000 | Baldwin | |
| 6,122,772 | A | 9/2000 | De Guzman | |
| 6,334,220 | B1 * | 1/2002 | Frye | A41B 13/103 2/49.2 |
| 6,941,579 | B2 | 9/2005 | Tanenbaum | |
| 7,269,859 | B2 | 9/2007 | Wells | |
| 7,451,497 | B2 | 11/2008 | Blücher | |
| 7,722,589 | B2 | 5/2010 | Fitts, Jr. et al. | |
| 2003/0074710 | A1 * | 4/2003 | Sanders | A41B 13/103 2/48 |
| 2003/0233695 | A1 | 12/2003 | Golde | |
| 2006/0085887 | A1 | 4/2006 | Palomo et al. | |
| 2007/0049894 | A1 * | 3/2007 | Fitts, Jr. | A61F 13/8405 604/385.22 |
| 2009/0124949 | A1 | 5/2009 | Rosen | |
| 2010/0017939 | A1 | 1/2010 | Carpenter, Jr. | |
| 2011/0239349 | A1 | 10/2011 | Thompson | |
| 2014/0157475 | A1 | 6/2014 | Smith et al. | |

* cited by examiner

APPARATUS, SYSTEMS, AND METHODS FOR PREVENTING FLUID FROM ENTERING AN INTERFACE

CROSS-REFERENCE TO RELATED APPLICATIONS

The present application claims priority to U.S. Provisional Application Ser. No. 62/848,635, filed on May 16, 2019, which is incorporated herein in its entirety by reference thereto.

FIELD

The subject matter of the present disclosure relates generally to protective coverings and, more particularly, to apparatus, systems, and methods for preventing fluid from entering an interface, such as a gown-glove interface.

BACKGROUND

Some medical procedures expose healthcare providers to a higher risk of exposure to bodily fluids, such as a patient's blood. Personal protective equipment (PPE), such as gloves, gowns, and/or long-sleeved surgical suits, is designed to limit or prevent such exposure. For example, gloves are designed to fit over surgical gown sleeves, but typically, gloves do not provide a sealed interface between the gown and glove. In fact, many times, bunching of the gown sleeve under the glove can create a channeling effect where fluids can follow the bunching of the sleeve and flow underneath the glove, exposing a healthcare provider's bare hands and/or arms to the patient's bodily fluids, which could lead to contamination and/or infection of the healthcare provider. In addition, the glove cuff can sometimes slide down on itself, decreasing its protective area. Although improvements have been made to the materials and designs of both surgical gowns and surgical gloves, little attention has been paid to the junction or interface between the sleeve of the gown and the glove, known as the gown-glove interface. Often, it is at the gown-glove interface that body fluids or bloodborne pathogens, which may contain harmful or infectious diseases, may breach the protective barrier worn by the healthcare provider.

Consequently, there is a need for an improved barrier against bodily fluids and/or other contaminants entering the gown-glove interface or other interfaces. In particular, a strap that wraps around a user near an interface between two interfacing items, such as a surgical gown and glove, to stop fluid from entering the interface would be desirable. Further, such a strap configured as an accessory that can be used interchangeably with various models of surgical gowns, gloves or full surgical personal protective equipment bundles would be beneficial. More particularly, a strap that may be adjustable by means of a stretchable material and absorptive by means of a layer of absorptive material or nonwoven comprising a superabsorbent material, such that the strap may contain bodily fluid would be useful.

SUMMARY

Additional aspects and advantages of the invention will be set forth in part in the following description, may be apparent from the description, or may be learned through practice of the invention.

In one aspect, the present subject matter is directed to a strap for preventing fluid from entering a glove worn by a user. The strap comprises a first layer comprising an elastic material and a second layer comprising a superabsorbent material. The strap extends about or around a gown worn by the user at a position at or near the glove.

It should also be understood that the strap may further include any of the additional features as described herein. For instance, in some embodiments, the strap further comprises a third layer comprising the elastic material, and the second layer is disposed between the first layer and the third layer.

In further embodiments, the elastic material comprises elastic filaments, and the first layer further comprises a nonwoven material facing for the elastic filaments. In other embodiments, the elastic material comprises an elastic film, and the first layer further comprises a nonwoven material facing for the elastic film.

In yet other embodiments, the superabsorbent material comprises a carded web comprising superabsorbent fibers. In some embodiments, the superabsorbent material comprises a carded web comprising superabsorbent polymer fibers and cellulose fibers. In other embodiments, the superabsorbent material comprises a superabsorbent polymer powder or superabsorbent polymer granules.

In still further embodiments, the strap also comprises a tab disposed at a first end of the strap. In some embodiments, the tab comprises hooks for attaching the strap to the gown.

In other embodiments, the second layer further comprises a blood coagulating chemistry. In some embodiments, an absorbable hemostat comprises the blood coagulating chemistry. In still other embodiments, an absorbable hemostat is applied as a coating to at least one of the first layer and the second layer.

In yet other embodiments, the strap further comprises a third layer comprising a nonwoven material, and the second layer is disposed between the first layer and the third layer. In some embodiments, the superabsorbent material comprises a carded web comprising superabsorbent polymer fibers and cellulose fiber, and wherein the elastic material comprises elastic filaments.

In still other embodiments, the strap extends about the gown at the user's forearm, at a position above a cuff of the glove.

In some embodiments, the strap extends about the gown at a position where the glove overlaps with the gown such that the strap extends about both the gown and the glove.

In another aspect, the present subject matter is directed to a strap for preventing fluid from entering an interface. The strap comprises a first layer comprising an elastic material and a second layer comprising a superabsorbent material. The strap extends about or around a first material at a position at or near an interface between the first material and a second material.

It should also be appreciated that the strap may further include any of the additional features as described herein. For example, in some embodiments, the strap further comprises a tab disposed at a first end of the strap. In further embodiments, the tab comprises hooks for attaching the strap to the first material. Moreover, in some embodiments, the strap also comprises a third layer comprising a nonwoven material, and the second layer is disposed between the first layer and the third layer.

In still another aspect, the present subject matter is directed to a strap for preventing fluid from entering a glove worn by a user. The strap comprises an absorptive facing and an elastic laminate. The absorptive facing comprises a carded web containing superabsorbent fibers. Further, the absorptive facing and elastic laminate form a stretchable material having absorptive properties. It should also be understood that the strap may further include any of the additional features as described herein.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIGS. 4A-1, 4A-2, and 4A-3 provide schematic views of a sheet of layered material, the sheet perforated into multiple strips for forming one or more straps as shown in FIGS. 1A and 1B, according to an exemplary embodiment of the present subject matter.

FIGS. 4B-1 and 4B-2 provide schematic views of a sheet of layered material, the sheet perforated into multiple strips for forming one or more straps without the tab illustrated in FIGS. 1A and 1B, according to an exemplary embodiment of the present subject matter.

DETAILED DESCRIPTION

Figure 1A:
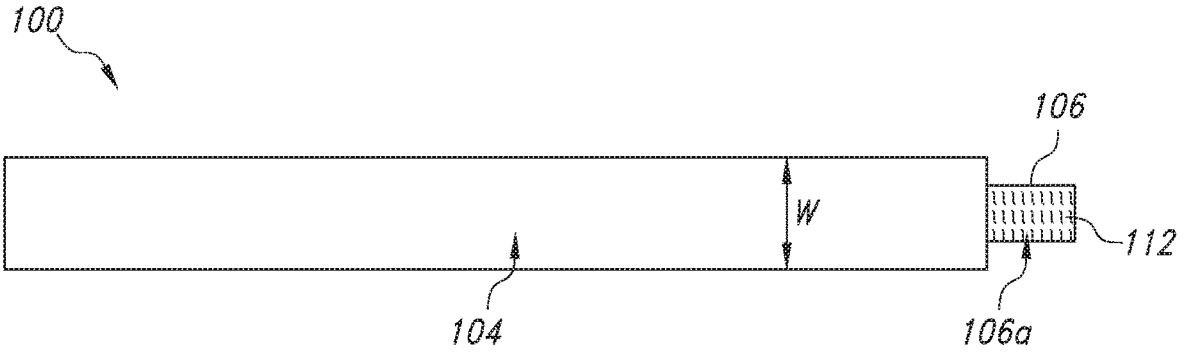
FIGS. 1A and 1B provide schematic views of a strap for preventing fluid from entering an interface, according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "about," "approximately," or "generally," when used to modify a value, indicates that the value may be raised or lowered by 5% and remain within the disclosed embodiment. Further, for the purposes of this description, proximal generally indicates that portion of a component next to or nearer to a hand of a wearer (when the component is in use), while the term distal generally indicates a portion further away from the hand of a wearer and nearer to the body of the wearer (when the component is in use).

Described herein are straps or similar accessories suitable for use in a variety of procedures for absorbing and containing fluid. While described in conjunction with its use in surgical room procedures located in hospitals, ambulatory surgical facilities, or the like, the present subject matter is intended for use wherever there is a need for preventing fluid from entering an interface. Consequently, the following description should not be considered a limitation as to the scope of use of the present subject matter.

Generally, the present subject matter provides apparatus and methods for preventing a fluid from entering an interface. For example, the present subject matter provides a strap for preventing fluid from entering a glove worn by a user, such as a glove worn by a healthcare provider. The user also may wear a gown, and the glove and gown may interface at a glove cuff and a gown cuff, e.g., positioned at or near the user's wrist or forearm. The strap may extend about the gown worn by the user at a position at or near the glove, e.g., the strap may extend about the gown at or near the glove cuff and, thus, at or near the interface between the gown and glove. The strap may be formed from a laminate of different material layers. For instance, a first layer may comprise an elastic material and a second layer may comprise a superabsorbent material. The superabsorbent material of the strap may absorb and contain fluid that comes in contact with the strap, reducing or eliminating the amount of fluid that may penetrate the interface, e.g., between the gown and glove. Further, the elastic material may allow the strap to stretch such that a tight fit may be achieved for any user. The stretchability of the strap also may allow repositioning and adjustment of the strap. These and other features as described herein can help prevent fluid from reaching the interface between the interfacing items, e.g., the gown and the glove, and thereby help prevent fluid from flowing into the interface and potentially contaminating whatever is beyond the interface, e.g., a healthcare provider's bare skin.

Figure 1B:
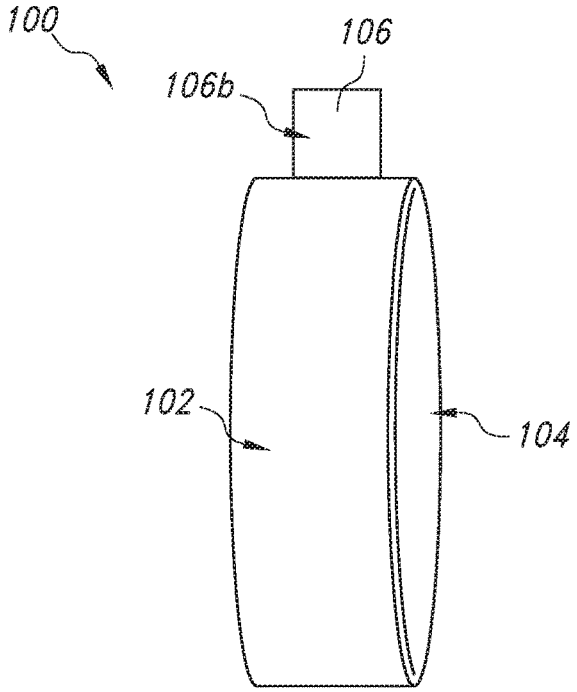

Referring now to the figures, FIGS. 1A and 1B provide schematic views of a strap for preventing fluid from entering an interface, according to an exemplary embodiment of the present subject matter. As illustrated in FIGS. 1A and 1B, the strap 100 comprises an outer surface 102, an inner surface 104, and a tab 106. The tab 106 may be disposed at a first end 108 or a second end 110 of the strap 100; in the depicted embodiment, the tab 106 is disposed or attached to the first end 108. In some embodiments, the tab 106 may be omitted.

In some embodiments, the strap 100 extends about or around a first material at a position at or near an interface between the first material and a second material. In such embodiments, the tab 106 may comprise hooks 112 for attaching the strap to the first material. The hooks 112 may be disposed on an inner surface 106*a* of the tab 106, but in some embodiments, the hooks 112 may be disposed on an outer surface 106*b* of the tab 106 or on both the inner and outer surfaces 106*a*, 106*b*. The hooks 112 may be, e.g., formed into the tab 106 or coupled to the tab 106 such that the tab 106 may attach to the first material in a similar fashion as a hook and loop fastener. In embodiments in which the tab 106 is omitted, the hooks 112 may formed into the outer surface 102, inner surface 104, or both surfaces 102, 104 of the strap 100. As will be described in greater detail herein, the first material may be the material from which a gown, such as a gown worn by a surgeon or other healthcare provider in a surgical or other healthcare setting, is formed, such that the outer surface 102, inner surface 104, or tab 106 is configured to attach to the gown material. As further described herein, the second material may be a glove, such as a nitrile or other type glove, such that the strap 100 is positioned at or near the interface between a cuff of the gown and a cuff of the glove.

Figure 2:
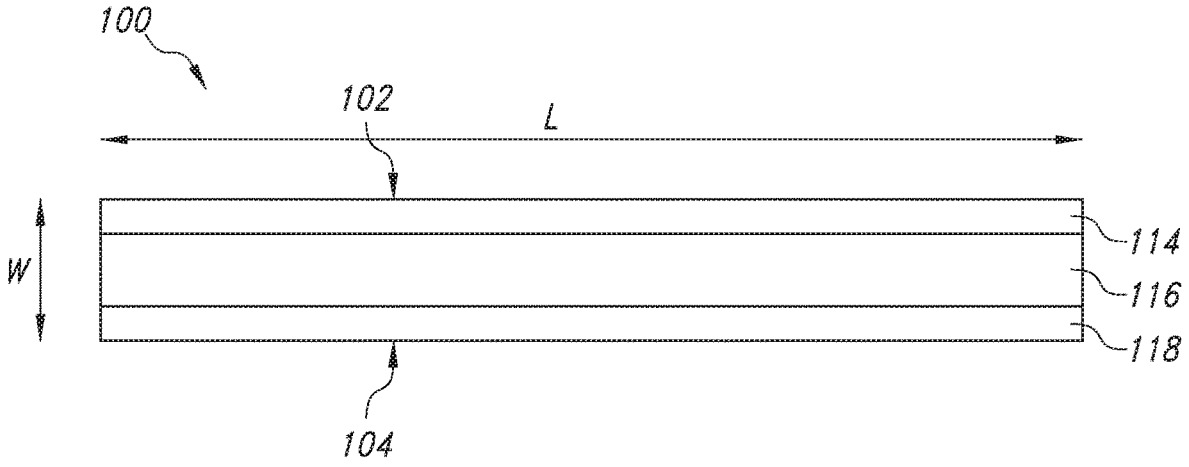
FIG. 2 provides a schematic cross-section view of the strap of FIGS. 1A and 1B, illustrating various layers of a laminate forming the strap, according to an exemplary embodiment of the present subject matter.

Referring now to FIG. 2, the strap 100 may be formed as a laminate of several different material layers. In the depicted embodiment, the strap 100 comprises three layers, a first layer 114, a second layer 116, and a third layer 118, with the second layer 116 disposed between the first layer 114 and the third layer 118. As further shown in FIG. 2, the strap 100 may have a length l and a thickness t. Moreover, referring back to FIG. 1A, the strap 100 may have a width w. Each of the length l, width w, and thickness t may vary between embodiments of the strap 100. For instance, the width w may vary from a relatively narrow width w to a relatively broad width w, which may allow various embodiments of the strap 100 to have different levels of fluid absorption and flow control (e.g., to accommodate different quantities and rates of fluid flow), as well as different degrees of fit with respect to, e.g., a glove 120 and/or a gown 122 (FIG. 3) as discussed herein. As an example, a strap 100 with a narrower width w may be used in situations in which the strap 100 is exposed to less fluid (e.g., in an operation involving less fluid or when the strap 100 is used in conjunction with one or more other means for controlling fluid) such that the strap 100 is required to absorb and control less fluid than in other situations. As another example, a wider strap 100, i.e., a strap 100 with a broader width w, may be used in situations in which a tighter or more secure fit is desired between the strap 100 and an underlying material, such as a gown and/or glove. That is, a wider strap 100 may provide a greater or more contact area between the strap 100 and the underlying material to allow a better, tighter, and/or more secure fit between the strap 100 and the underlying material. In some embodiments, the width w of the strap 100 may range from about one half of one inch (½ in.) to about six inches (6 in.); more particularly, the width w of the strap 100 may range from about one inch (1 in.) to about four inches (4 in.).

Figure 3:
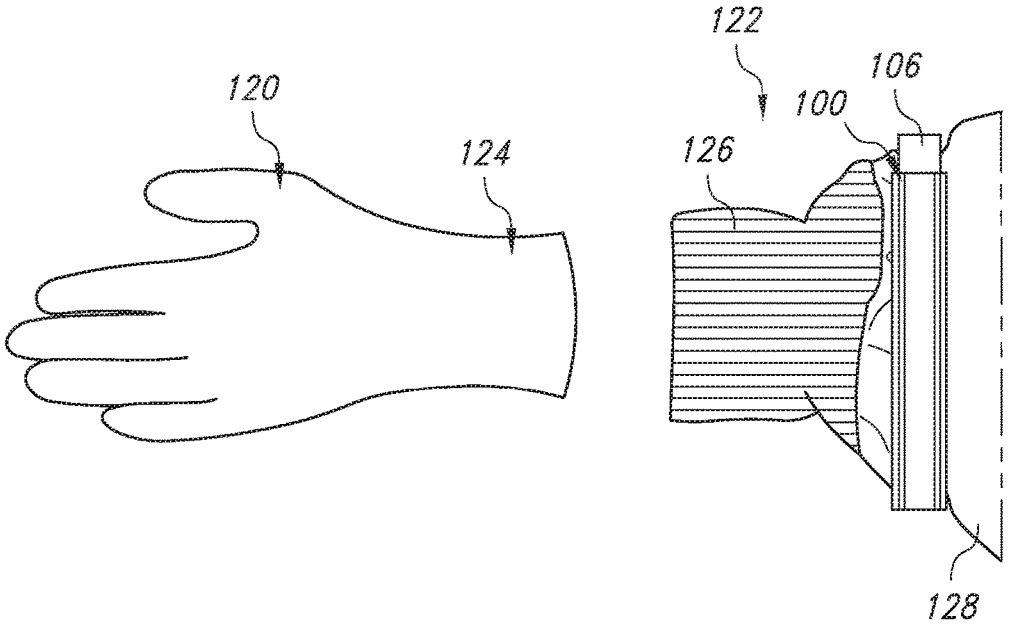
FIG. 3 provides a schematic view of the strap of FIGS. 1A and 1B configured for preventing fluid from entering the interface between a surgical gown and a glove, according to an exemplary embodiment of the present subject matter.
Figures 1, 4A:
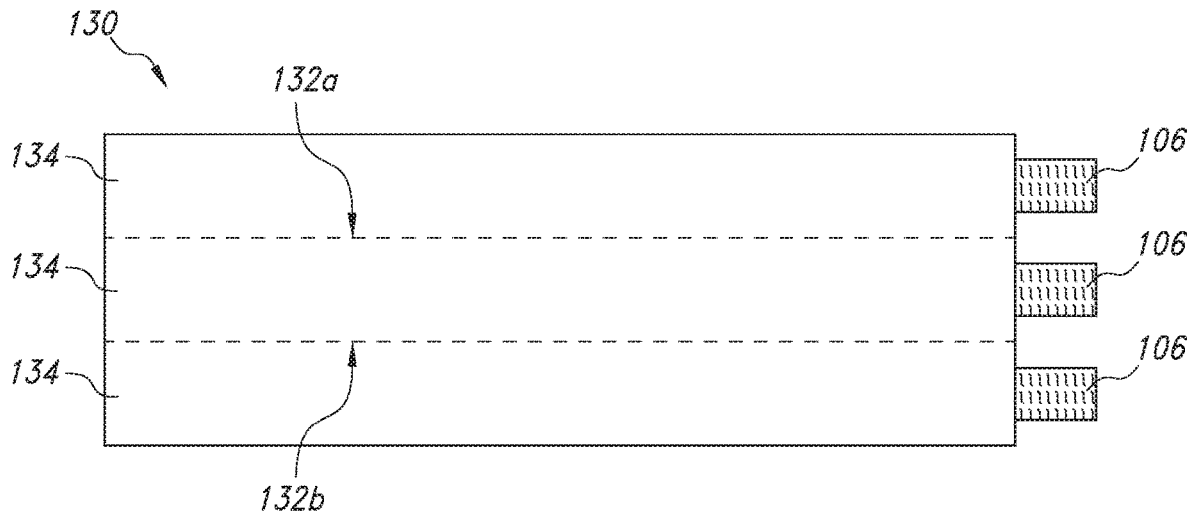
Figures 2, 4A:
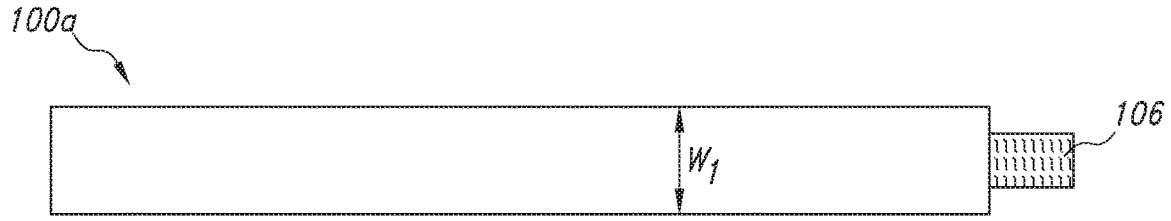
Figures 3, 4A:
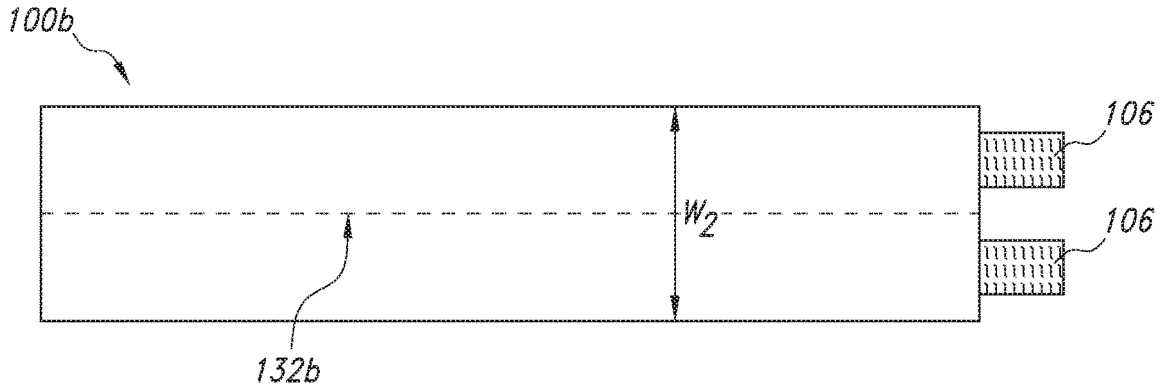

As shown in FIG. 4A, in some embodiments, the layered material forming the strap 100 may be provided in size-selectable sheets such that a single sheet may provide straps 100 of various widths w. More particularly, a sheet 130 of the layered material (e.g., a sheet comprising the first layer 114, the second layer 116, and the third layer 118) may comprise one or more perforated lines 132 extending lengthwise along the sheet 130 to define multiple strips 134 of the layered material. In one embodiment, the sheet 130 may be torn along a first perforated line 132*a* to detach a first strap 100*a* having a first width $w_1$, and/or the sheet 130 may be left intact along a second perforated line 132*b* (i.e., not torn along the second perforated line 132*b*) to form a strap 100*b* having a second width $w_2$. As shown in FIG. 4A-2 and FIG. 4A-3, the first strap 100*a* comprises only one strip 134 of the layered material, while the second strap 100*b* comprises two strips 134 of the layered material, such that the second width $w_2$ is greater than the first width $w_1$. Accordingly, a user may tear out a strap 100 having the width w the user needs by tearing the sheet 130 along the perforation 132 that will yield the strap 100 having the desired width w.

Figures 1, 4B:
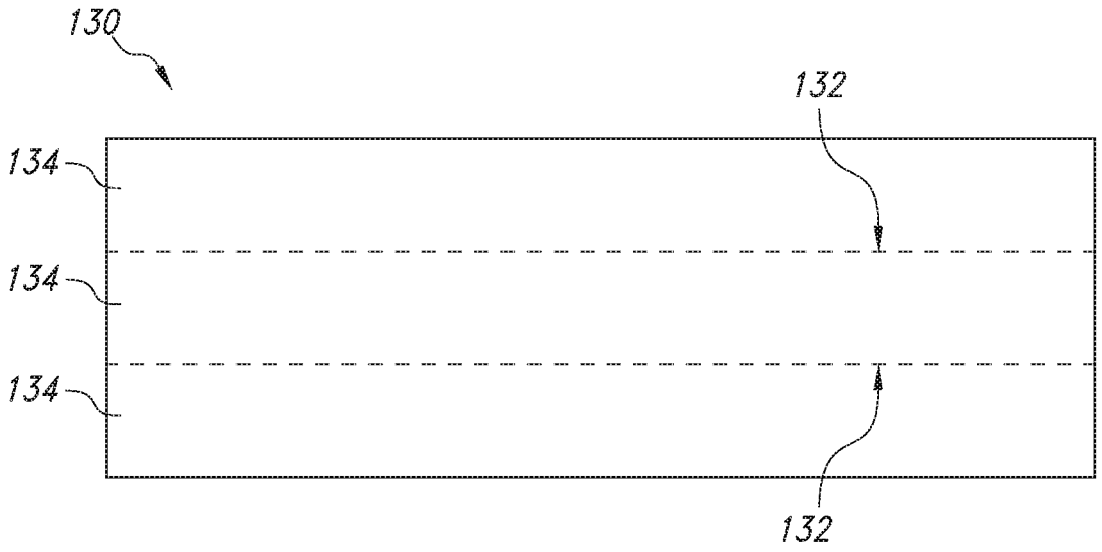
Figures 2, 4B:
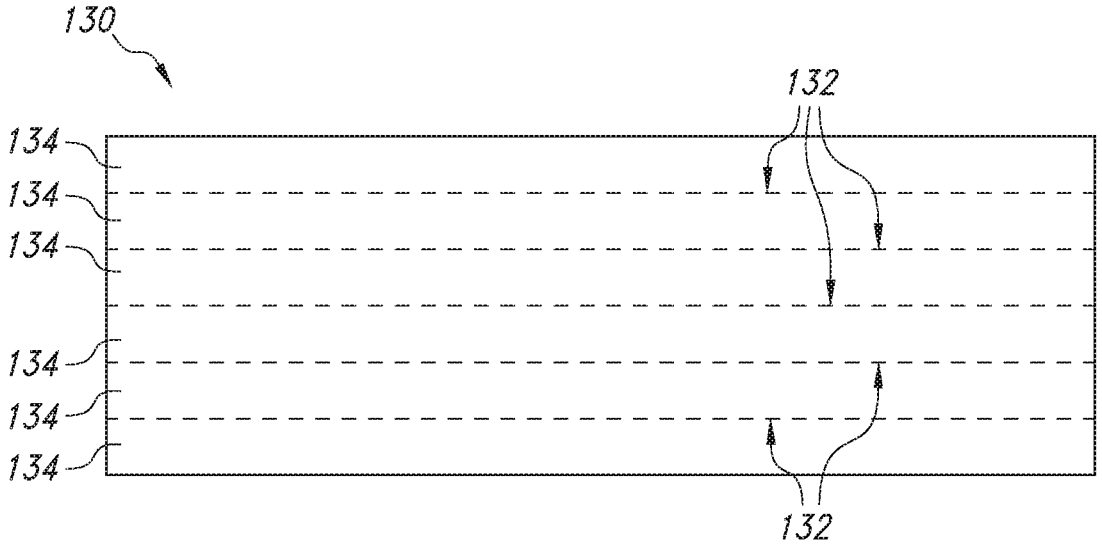

As described herein, the strap 100 may comprise a tab 106, such that a tab 106 is formed with each strip 134 as shown in FIG. 4A. In other embodiments, the tab 106 may be omitted. Thus, as illustrated in FIG. 4B, the strips 134 formed by the perforations 132 in sheet 130 may not include a tab 106.

In an exemplary embodiment, the sheet 130 of the layered material is six inches (6 in.) wide with two perforations 132 that define three (3) two inch (2 in.) wide strips 134, i.e., three (3) strips 134 that are each two inches (2 in.) wide are joined along perforations 132 in a six-inch-wide (6 in.-wide) sheet 130. In another exemplary embodiment, the sheet 130 of the layered material is six inches (6 in.) wide with five perforations 132 that define six (6) one inch (1 in.) wide strips 134, i.e., six (6) strips 134 that are each one inch (1 in.) wide are joined along perforations 132 in a six-inch-wide (6 in.-wide) sheet 130. Other numbers of strips 134 may be defined by perforated lines 132 along a single sheet 130. The user may tear off one or more strips 134 from a sheet 130, e.g., based on a width w needed for a certain application as described above, to form one or more straps 100. Of course, in some situations, a user may utilize strips 134 from two or more sheets 130 to form one or more straps 100. Further, the strips 134, which form one or more straps 100, may be placed or used together (i.e., in one location) or separately (i.e., at separate, different locations).

The layers 114, 116, 118 are bonded or otherwise joined together as a laminate. The first layer 114 comprises an elastic material and the second layer 116 comprises a superabsorbent material. In some embodiments, the third layer 118 also may comprise the elastic material, but in other embodiments, the third layer 118 is merely a facing layer formed from a nonwoven material. More particularly, in some embodiments, the third layer 118 may be substantially similar to the first layer 114 (i.e., the third layer 118 comprises the elastic material), while in other embodiments, the third layer 118 is formed from a nonwoven material that is substantially devoid of elastic material (i.e., the third layer 118 does not contain the elastic material of the first layer 116). It will be appreciated that, in other embodiments, the strap 100 may comprise only two layers or may comprise more than three layers. In still other embodiments, the elastic and absorptive properties of the elastic material and the superabsorbent material may be combined into a single layer such that the strap 100 comprises only one layer.

In exemplary embodiments, the second layer 116 may be configured as an absorptive facing, and at least one of the first layer 114 and the third layer 118 may be configured as an elastic laminate joined to the absorptive facing. The absorptive facing 116 may comprise a carded web containing superabsorbent fibers, as described in greater detail herein. The absorptive facing 116 and elastic laminate 114 and/or 118 may form a stretchable material having absorptive properties as described herein.

In some embodiments, the elastic material comprises elastic filaments (e.g., LYCRA® fiber by The LYCRA Company), and the first layer 114 further comprises a nonwoven material facing laminate for the elastic filaments. In other embodiments, the elastic material comprises an elastic film, and the first layer 114 further comprises a nonwoven material facing laminate for the elastic film. More specifically, the nonwoven material provides a facing for the stretchable elastic material. The elastic material allows the strap 100 to stretch, such that the strap 100 may be adjusted to fit any user tightly or snugly and may be repositioned or readjusted. Further, the elasticity provides back pull on the strap 100, which may provide recoil and/or stretch recovery to help ensure a tight fit on any user over many uses of the strap 100.

Moreover, in some embodiments, the superabsorbent material comprises a carded web comprising superabsorbent fibers. For example, the carded web may comprise a blend of superabsorbent fibers and polymer fibers such as polypropylene (PP) or polyethylene terephthalate (PET) fibers. Additionally or alternatively, the superabsorbent material comprises a carded web comprising superabsorbent fibers and cellulose fibers. For instance, the carded web may comprise a blend of superabsorbent polymer fibers and cellulose fibers such as viscose. In various exemplary embodiments, the carded web may be a thermally bonded carded web (TBCW) or a through-air bonded carded web (TABCW). In an exemplary embodiment, the second layer 116 may comprise an absorptive TBCW or TABCW facing (such as SH-PPO-35) containing up to 50% superabsorbent fibers (such as superabsorbent fibers used by Shalag Industries), and the first layer 114 may comprise an elastic filament laminate or an elastic film laminate (such as a laminate from Invista or Mondi). In other embodiments, more than 50% of the fibers in the second layer 116 may be superabsorbent fibers.

The superabsorbent material may absorb and contain fluid that contacts the strap 100. By absorbing and containing fluid, the strap 100 may help reduce or eliminate fluid available to flow under, e.g., a healthcare provider's glove and to the healthcare provider's bare skin. Further, the superabsorbent material may be configured to swell when exposed to one or more fluids, such as blood and/or other bodily fluids, thereby creating a better pressure seal by tightening the strap 100. As an example, an exemplary superabsorbent material may react with the water in blood to quickly solidify and create a seal. Thus, the inclusion of the superabsorbent material in the strap 100 may help tighten the fit of the strap 100 after the superabsorbent material absorbs fluid, which may improve the sealing or fluid barrier capability of the strap 100.

Moreover, polyolefin-based fibers and their resultant nonwovens may be well-suited for the production of a laminate for the strap 100. Polypropylene spunbonded nonwovens may be used to impart strength characteristics to the strap 100. In some embodiments, the strap 100 may be formed in part from laminates such as a laminate of spunbonded and meltblown or spunbonded-meltblown-spunbonded, which may impart both strength and barrier properties to the strap 100.

More particularly, a spunbonded-meltblown-spunbonded material, also commonly referred to by the acronym "SMS," is made from three separate layers that are laminated to one another. The two outer layers of SMS are a spunbonded material made from extruded polyolefin fibers, or filaments, laid down in a random pattern and then bonded to one another. The inner layer is a meltblown layer also made from extruded polyolefin fibers generally of a smaller diameter than the fibers in the spunbonded layers. As a result, the meltblown layer provides increased barrier properties due to its fine fiber structure, which permits the sterilizing agent to pass through the fabric while preventing passage of bacteria and other contaminants. Conversely, the two outer spunbonded layers provide a greater portion of the strength factor in the overall laminate. The laminate may be prepared using an intermittent bond pattern that is preferably employed with the pattern being substantially regularly repeating over the surface of the laminate. The pattern is selected such that the bonds may occupy about 5% to about 50% of the surface area of the laminate. For instance, the bonds may occupy about 10% to about 30% of the surface area of the laminate.

In an exemplary embodiment, the first layer 114 and the third layer 118 of the strap 100 each may comprise a nonwoven material, such as SMS, containing elastic filaments such that each of the first layer 114 and third layer 118 comprises an elastic material contributing the ability of the strap 100 to stretch. The first layer 114 may define the outer surface 102 of the strap 100 and the third layer 118 may define the inner surface 104 of the strap 100; alternatively, third layer 118 may define the outer surface 102 and the first layer 114 may define the inner surface 104. Further, the second layer 116 may comprise a nonwoven material, such as a carded web, that may comprise a polymer and/or cellulose fibers, including a superabsorbent material. For example, the nonwoven material of the second layer 116 may include a polymer that is a superabsorbent polymer. The superabsorbent polymer may be in the form of superabsorbent fibers and/or superabsorbent powder/granules. In some embodiments, the nonwoven material of the second layer 116 comprises a mixture of superabsorbent polymer fibers and other fibers, such as cellulose, viscose rayon, polypropylene, polyester, and/or nylon. That is, the nonwoven material of the second layer 116 may comprise any natural or synthetic fiber or a mix of such fibers. The superabsorbent fibers may comprise a percentage of the carded staple fiber, and the other fibers in the mix/blend (such as the fibers listed above) may comprise the remaining percentage of the carded staple fiber. Thus, the superabsorbent fiber percentage of the carded staple fiber may be within a range of 0% to 100%, or from no superabsorbent fibers to exclusively superabsorbent fibers. In certain embodiments, the superabsorbent fiber percentage of the nonwoven material forming the second layer 116 is within a range of 30% to 80% (such that the remaining percentage of other fibers is within a range of 20% to 70%), and more particularly, the superabsorbent fiber percentage may be within a range of 40% to 60%.

As previously discussed, in other embodiments, the second layer 116 may comprise a superabsorbent powder or superabsorbent granules. The superabsorbent powder/granules may be sprayed or deposited onto a nonwoven layer or layers or sandwiched between nonwoven layers. The nonwoven layers onto which or between which the superabsorbent powder or superabsorbent granules are deposited could be made from, e.g., cellulose, viscose rayon, polypropylene, polyester, nylon, and/or any natural or any synthetic fiber or a mixture/blend of the such fibers. In any event, the superabsorbent material of the second layer 116, whether it comprises fibers, powder, and/or granules, may be sandwiched between the elastic material as described herein.

In another exemplary embodiment, one of the first layer 114 and the third layer 118 comprises a nonwoven material and is substantially devoid of the elastic material. The other of the first layer 114 and the third layer 118 does comprise the elastic material. For instance, the first layer 114 may comprise a nonwoven material, such as SMS, containing elastic filaments such that the first layer 114 comprises an elastic material, and the third layer 116 may comprise a nonwoven material, such as SMS, without elastic filaments, elastic film, or another elastic material. The second layer 116 may comprise a nonwoven material, such as a carded web, containing a polymer and/or cellulose fibers, including a superabsorbent material. As described above, in some embodiments, the nonwoven material of the second layer 116 may comprise superabsorbent polymer fibers, alone or in combination with other fibers, and in other embodiments, the second layer 116 may comprise a superabsorbent polymer powder and/or superabsorbent polymer granules, which may be deposited onto or between layers of a nonwoven material. In any event, as described herein, the superabsorbent material of the second layer 116, whether it comprises fibers, powder, and/or granules, may be sandwiched between a layer of elastic material and a layer of generally inelastic material.

In some embodiments, such as when the strap 100 is used in a medical setting as described in greater detail herein, the strap 100 also may include a blood coagulating chemistry. More particularly, blood coagulating chemistries may be used in conjunction with the absorptive properties of the superabsorbent material for additional fluid locking and infection prevention. For example, the second layer 116 may comprise a blood coagulating chemistry, and in some embodiments, the second layer 116 may include an absorbable hemostat that comprises the blood coagulating chemistry. As another example, an absorbable hemostat may be applied as a coating to at least one of the first layer 114, the second layer 116, and the third layer 118.

Referring to FIG. 3, in some embodiments, the strap may be worn with items such as a glove 120 and a gown 122 worn by a user of the strap 100, e.g., a surgeon in a surgical setting or by another healthcare provider in a surgical or other setting. More particularly, the glove 120 may include a glove cuff 124 that extends away from the user's hand and toward the user's elbow when the glove 120 is on the user's hand. The gown 122 may include a gown cuff 126 at the end of a sleeve 128 of the gown 122; the gown cuff 126 may be positioned at or near the user's wrist when the user's arm is inserted into the gown sleeve 128. As previously described, the gown 122 may be made from a first material, and the glove may be made from a second material.

In the exemplary embodiment depicted in FIG. 3, the user may don the glove 120 and the gown 122 such that the gown cuff 126 extends under the glove cuff 124. For instance, a user of the strap 100, such as a surgeon, may first don the gown 122, positioning the gown cuff 126 at or near the user's wrist. Next, the user may don the strap 100, wrapping the strap about the user's forearm above the gown cuff 126, i.e., toward the user's elbow relative to the gown cuff 126, such that the strap 100 extends about the gown 122. The tab 106 may be pressed against the gown 122 to secure the strap 100 in position relative to the gown 122. Then, the user may don the glove 120, positioning the glove cuff 124 over the gown cuff 126. In some embodiments, the glove cuff 124 may extend over the strap 100, such that the strap 100 is covered at least in part by the glove 120. In other embodiments, the glove cuff 124 may stop short of where the strap 100 wraps about the gown 122, such that the strap 100 is not covered by the glove 120. In yet other embodiments, the user may don the strap 100 after donning both the gown 122 and the glove 120 and may position the strap 100 on top of the glove cuff 124 such that the strap 100 extends about both the glove 120 and the gown 122. In still other embodiments, the glove cuff 124 may extend under the gown cuff 126, and the strap 100 may be positioned such that the strap 100 extends about only the gown 122 or both the gown 122 and the glove 120, which is positioned under the gown 122. Thus, in some embodiments, the strap 100 may extend about the gown 122 at a position where the glove 122 overlaps with the gown 122 such that the strap 100 extends about both the gown 122 and the glove 120.

Accordingly, in various embodiments, the strap 100 may extend about at least the gown 122 at a position at or near the glove 120, e.g., at a position at or near an interface between the gown 122 and the glove 120. Of course, in other embodiments, one or more strap 100 may be positioned in one or more other locations. For example, a strap 100 may be positioned such that the strap 100 extends about the gown sleeve 128 at the user's forearm at a position above the glove cuff 124. In some embodiments, a strap 100 may be positioned at the user's forearm approximately halfway between the user's wrist and the user's elbow. In other embodiments, a strap 100 may be positioned at the user's forearm just below the user's elbow, i.e., on a wrist side of the user's elbow, and/or just above the user's elbow, i.e., on a shoulder side of the user's elbow. It will be appreciated that a strap 100 may be positioned in other locations as well. Further, it will be understood that the user may don one or more straps 100, and when wearing more than one strap 100, each strap 100 may be positioned in a different location. As one example, a first strap 100 may be positioned at or near the glove 120 while a second strap 100 may positioned at or near the user's elbow.

In some embodiments, the strap 100 may comprise an adhesive on the outer surface 102 and/or the inner surface 104. The adhesive may allow the strap 100 to adhere to an overlying and/or underlying material, such as a gown and/or glove as described herein, which may help prevent fluid from reaching an undesirable location. More particularly, by adhering the strap 100 to an overlying and/or underlying material, a barrier may be formed against fluid seeping under the strap 100. In further embodiments, in addition to or in lieu of comprising an adhesive, the outer surface 102 and/or inner surface 104 may be formed from a material that sticks to itself, e.g., such that the outer surface 102 and/or inner surface 104 may be wrapped back on itself to form a pressure seal. In other embodiments, in addition to or in lieu of comprising an adhesive or the like, the outer surface 102 and/or inner surface 104 may comprise hooks formed, e.g., in a substrate supporting the superabsorbent material, that catch on material such as the material from which a surgical gown is made to secure the strap 100 in place. In still other embodiments, in addition to or in lieu of comprising an adhesive or the like, other types of fasteners, such as hook and loop fasteners, ties, snaps, etc. may be used to secure the outer surface 102 and/or inner surface 104 to itself and/or to another component, such as a gown or glove.

Moreover, although shown and described herein with respect to one strap 100, one glove 120, and one sleeve and cuff 118 of a gown 122, it will be understood that a strap 100 may be used at each glove and sleeve of the gown worn by the user, i.e., one strap 100 may be used on each arm of the user. Of course, a user may utilize other numbers of straps 100 as well, e.g., the user may wear two or more straps on each arm and/or may wear a different number of strap(s) 100 on one arm than on the other arm. Additionally or alternatively, the strap 100 may be used to absorb and contain fluids at other points of a surgeon's protective clothing or equipment or to absorb and contain fluids in other settings, e.g., a strap may be worn at or between other wearable items worn by other users in other settings.

Accordingly, the present subject matter provides several benefits and advantages. For instance, the present subject matter provides a strap for preventing fluid from entering an interface, such as for preventing fluid from entering a glove worn by a user with a gown. For example, the present subject matter provides an adjustable, absorptive strap to prevent flow of bodily fluid such as blood from entering into a glove of a surgeon or other healthcare provided, e.g., during an operating room (OR) procedure. The strap may use an elastic or stretchable nonwoven material that has superabsorbent fibers such that the strap is adjustable and contains and absorbs fluid, e.g., contains and absorbs bodily fluid to prevent the fluids from entering into the user's glove and contacting the user's bare skin. The strap may include a fastener tab, e.g., comprising hooks similar to those used in a hook and loop fastener, to help the user adjust the positioning and tension of the strap, e.g., during and throughout an OR procedure. The fastener tab also may help keep the strap in position, e.g., with respect to the user's gown and glove. Further, blood coagulating chemistries may be used in conjunction with the absorptive properties of the strap, e.g., for additional fluid locking and infection prevention. Other benefits and advantages also may be realized from the present subject matter.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A strap for preventing fluid from entering a glove worn by a user, the strap comprising:

a first layer comprising an elastic material;

a second layer comprising a superabsorbent material, wherein the superabsorbent material comprises a carded web comprising superabsorbent polymer fibers and different polymer fibers, the different polymer fibers comprising polypropylene or polyethylene terephthalate fibers; and wherein the strap is adapted to extend about a gown worn by the user at a position at or near the glove, wherein the first layer and the second layer are bonded together as a laminate.

2. The strap of claim 1, wherein the elastic material comprises elastic filaments, and wherein the first layer further comprises a nonwoven material facing for the elastic filaments.

3. The strap of claim 1, wherein the elastic material comprises an elastic film, and wherein the first layer further comprises a nonwoven material facing for the elastic film.

4. The strap of claim 1, wherein the superabsorbent material comprises a superabsorbent polymer powder.

5. The strap of claim 1, further comprising:

a tab disposed at a first end of the strap.

6. The strap of claim 5, wherein the tab comprises hooks for attaching the strap to the gown.

7. The strap of claim 1, wherein the second layer further comprises a blood coagulating chemistry, wherein an absorbable hemostat comprises the blood coagulating chemistry.

8. The strap of claim 1, wherein an absorbable hemostat is a coating to at least one of the first layer and the second layer.

9. The strap of claim 1, further comprising:

a third layer comprising a nonwoven material, wherein the second layer is disposed between the first layer and the third layer.

10. The strap of claim 9, wherein the superabsorbent material comprises the carded web comprising the superabsorbent polymer fibers and cellulose fiber, and wherein the elastic material comprises elastic filaments.

11. The strap of claim 1, wherein the strap is adapted to extend about the gown at the user's forearm, at a position above a cuff of the glove.

12. The strap of claim 1, wherein the strap is adapted to extend about the gown at a position where the glove overlaps with the gown such that the strap extends about both the gown and the glove.

13. A strap for preventing fluid from entering an interface, the strap comprising:

a first layer comprising an elastic material;

a second layer comprising a superabsorbent material; and a plurality of tabs disposed at a first end of the strap, wherein the strap is adapted to extend about a first material at a position at or near an interface between the first material and a second material, wherein the strap is formed from a size-selectable sheet of material comprising the first layer and the second layer, wherein the size-selectable sheet comprises one or more perforated lines extending lengthwise along the size-selectable sheet to define multiple strips such that a width of the strap is variable by tearing the size-selectable sheet along the one or more perforated lines, wherein the strap defines a length and the width, wherein the length of the strap is greater than the width of the strap, wherein the one or more perforated lines extend along the length of the strap to define the multiple strips, wherein each strip comprises a tab of the plurality of tabs at a first end of each strip.

14. The strap of claim 13, wherein the plurality of tabs comprise hooks for attaching each of the strips to the first material.

15. The strap of claim 13, further comprising:

a third layer comprising a nonwoven material, wherein the second layer is disposed between the first layer and the third layer.

16. The strap of claim 13, wherein the multiple strips comprise the same length.

17. A strap for preventing fluid from entering a glove worn by a user, the strap comprising:

an absorptive facing; and an elastic laminate, wherein the absorptive facing comprises a carded web containing superabsorbent polymer fibers and different polymer fibers, the different polymer fibers comprising polypropylene or polyethylene terephthalate fibers, and wherein the absorptive facing and form a stretchable material having absorptive properties, wherein the absorptive facing and the elastic laminate are bonded together as a laminate.

* * * * *